US005104107A

United States Patent [19]

Dash

[11] Patent Number: 5,104,107

[45] Date of Patent: Apr. 14, 1992

[54] FOLD CONDITIONER AND METHOD

[75] Inventor: Thomas E. Dash, Aurora, Ill.

[73] Assignee: Wallace Computer Services, Inc., Hillside, Ill.

[21] Appl. No.: 694,061

[22] Filed: May 1, 1991

[51] Int. Cl.[5] ..... B41L 1/39

[52] U.S. Cl. ..... 270/39; 493/410

[58] Field of Search ..... 270/39, 40, 41, 21.1, 270/32; 493/406, 410–415; 226/88, 119

[56] References Cited

U.S. PATENT DOCUMENTS

| | | | |
|---|---|---|---|
| 4,094,451 | 6/1978 | Wescot | 226/88 |
| 4,427,404 | 1/1984 | Yamada | 493/414 |
| 4,507,109 | 3/1985 | Meschi | 493/412 |
| 4,726,578 | 2/1988 | Hickmar | 493/413 |
| 4,730,762 | 3/1988 | Felix | 270/39 |
| 4,811,688 | 3/1989 | Turner | 270/39 |
| 4,846,386 | 7/1989 | Gresens | 226/119 |
| 4,846,454 | 7/1989 | Parkander . | |
| 4,928,940 | 5/1990 | Dash . | |

FOREIGN PATENT DOCUMENTS

| | | | |
|---|---|---|---|
| 1141610 | 12/1962 | Fed. Rep. of Germany | 493/411 |
| 2503701 | 8/1976 | Fed. Rep. of Germany | 493/406 |
| 41168 | 2/1987 | Japan | 270/31 |

*Primary Examiner*—Edward K. Look
*Assistant Examiner*—Therese M. Newholm
*Attorney, Agent, or Firm*—Tilton, Fallon, Lungmus & Chestnut

[57] ABSTRACT

Method and apparatus for fold conditioning a continuous business form web having longitudinally-extending control punch margins and equally longitudinally-spaced apart lines of transverse perforation including advancing the web along a longitudinally extending path from a printer to a folder both of which operate at a predetermined normal speed and wherein the conditioning apparatus includes a plurality of offset rollers arranged in zig-zag fashion to provide a serpentine path to alternately contact opposite sides of the web and with some of the rollers being operated at a surface speed at least greater than the predetermined normal speed.

9 Claims, 1 Drawing Sheet

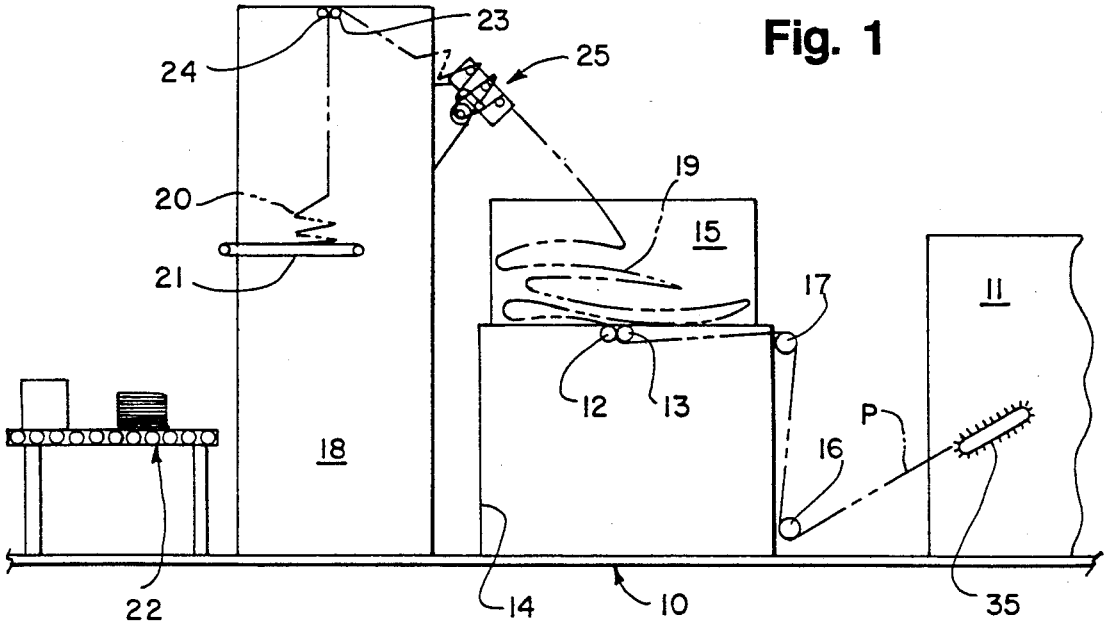
Fig. 1
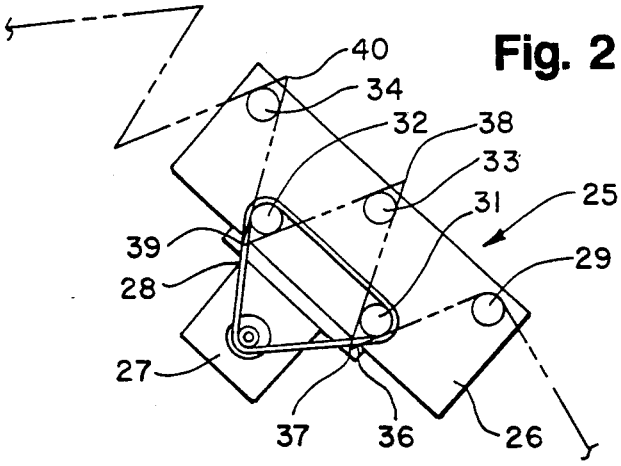
Fig. 2
Fig. 3
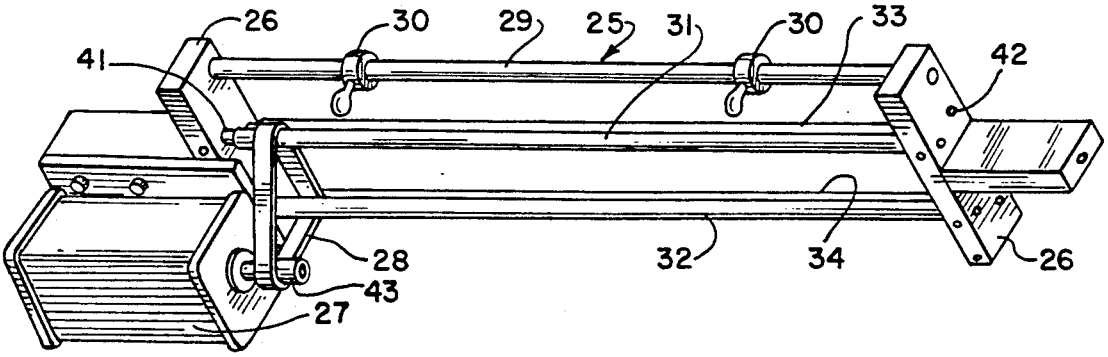

FOLD CONDITIONER AND METHOD

BACKGROUND AND SUMMARY OF INVENTION

This invention relates to a fold conditioner and method and, more particularly, to fold conditioning a continuous business form web having longitudinally-extending control punch margins and equally longitudinally-spaced apart lines of transverse perforation.

This invention is an improvement on U.S. Pat. No. 4,846,454 which had to do with a job separator. The job separator eliminated the need for inserting a tab in the output zig-zag folded stack and also had the advantage of providing substacks with "first page up".

Part of the job separator of the '454 patent included softening means for subjecting the web prior to folding to a braking force to stretch the web and bend the same so as to facilitate subsequent folding.

The instant invention goes the other way and avoids stretching of the web incident to prefolding or conditioning and employs an array of rollers forming a serpentine path, some of the rollers being driven at least faster than the line speed of the web. This has resulted not only in significantly increased performance but substantial savings. Quite a number of job separators according to the '454 patent have been sold and the relatively simple device for softening had to be removed or bypassed and a folder costing upwards of $50,000 installed in its place. Now that substantial expenditure is avoided by the practice of the invention.

Other objects and advantages of the invention may be seen in the details of the ensuing specification.

DETAILED DESCRIPTION OF DRAWING

The invention is described in conjunction with the accompanying drawing, in which FIG. 1 is a side elevational view, essentially schematic, of apparatus employed in the practice of the invention;

FIG. 2 is an enlarged side elevational view of a portion of the apparatus in FIG. 1 and featuring the inventive fold conditioner; and FIG. 3 is an enlarged perspective view of the fold conditioner of FIGS. 1 and 2.

DETAILED DESCRIPTION

In the illustration given and with reference first to FIG. 1, the numeral 10 generally designates schematically frame means for connecting the various pieces of apparatus together. It will be understood that in some instances there need not be interconnecting frame portions but in any event, the various pieces of apparatus together form a longitudinally extending path for web travel generally parallel to the frame means 10.

For example, the numeral 11 designates a printer complete with unwind and which advantageously may be of the laser variety. The printer is equipped with pin belts for advancing the web through the printer after which the now-printed web is advanced by pull or draw rolls, 12, 13 provided on a frame 14 which supports an accumulator 15. Further details of the accumulator 15 can be seen in co-owned U.S. Pat. No. 4,928,940.

The web path P (see the right hand side of FIG. 1) features the web issuing from the printer and unwind 11 around idler rolls 16 and 17 under the influence of the draw rolls 12, 13. When, for example, the job separator 18 is operating at a capacity less than that of the printer 11, printed web material is accumulated in random loops as at 19 in the accumulator 15. Advantageously, however, the line speed of the web in the printer 11 and the job separator 18 are equal.

After the web is folded into zig-zag folded stacks 20 on an elevator 21 provided as part of the job separator 18, the elevator 21 moves the stacks laterally onto an output conveyor generally designated 22. Between the accumulator 15 and the stack 20, the web is advanced by further draw rolls 23, 24 provided as part of the job separator.

Interposed between the accumulator 15 (if one is employed) and the job separator 18 (or folder if no job separator is employed) is the fold conditioner generally designated 25 and which can be seen in larger scale in FIG. 2 and in perspective in FIG. 3.

FOLD CONDITIONER

The fold conditioner consists essentially of a pair of side frames 26 which support a plurality of rollers, some of which are driven by means of a motor 27 and a belt drive 28.

Starting from the right in FIG. 2 the first roller encountered by the web W is a stationary or fixed roller 29 which serves as a guide for the web issuing either from the accumulator 15 or the printer 11. For this purpose, the roller 29 is equipped with guide clamps 30 (see FIG. 3) defining the path P of travel of the now-printed web.

Thereafter, the web W engages two sub-pluralities of rollers as at 31 and 32 for one plurality and 33 and 34 for the other plurality. The rollers in each sub-plurality are spaced apart generally parallel to the path of web travel and the two sub-pluralities are also offset, one from the other—so as to form essentially a serpentine or zig-zag path of travel for web. It will be noted that the endless belt 28 is entrained around the rollers 31, 32 and, according to the invention, these rollers are driven at a surface speed at least greater than the line speed of the web. The line speed is that speed normally provided in both the printer 11 and the job separator 18 when there is no accumulation in the accumulator 15. In other words, the pin belts 35 in the printer 11 (see the right hand portion of FIG. 1), the draw rolls 12, 13 (see the center portion of FIG. 1) and the draw rolls 23, 24 of the job separator 18 (see the left hand portion of FIG. 1) all operate at the same surface speed under normal web advance conditions. It has been found advantageous to run the driven rollers 31, 32 at a speed approximately 20% higher than the line speed so as to avoid any drag on the web which could be productive of tearing the line holes in the control punch margins of the business form web. A typical web can be seen in the '454 patent and reference may be had thereto for details of web construction not shown herein.

OPERATION

The fold conditioner 25 introduces an incipient fold on both sides of the web W in the manner schematically depicted in FIG. 2. There, it will be seen that the web W in proceeding around the roller 31 develops a relatively sharp peak 36 which, in effect, prefolds the web in one direction along a line of transverse perforation 37. Here it will be appreciated that normally the web is provided either as a zig-zag or fan folded stack or in roll form on an unwind incident to entering the printer 11. The web W either in zig-zag folded stack or roll form is perforated transversely by the business form web manufacturer and again such transverse perforations may be seen clearly in the '454 patent.

After the first conditioning as at 36, a further conditioning is developed by the web passing around the roller 33 and developing a peak 38 which, in effect, prefolds the web the other direction, i.e., on the opposite side of the web. This procedure is repeated as at 39 relative to the roller 32 and as at 40 relative to the roller 34.

Excellent results have been obtained by operating the rollers at a surface speed of about 250 feet per minute which develops the relatively sharp peaks 36 and 38–40, much the same as would be achieved by serpentining the web around thin wires to "crack" the web along the lines of transverse perforation. As a practical matter, I have found that the smallest effective diameter of the rollers 31–34 is of the order of about ⅜", governed in some measure by the need for efficient economical bearings for the journals 41 (see the left portion of FIG. 3). I have found it advantageous to use journals 3/16" in diameter to fit within commercially available small bearings provided in the side frames 26 as, for example, at 42 (see the right portion of FIG. 3).

Further in the operation of the invention according to the illustrated embodiment, a 1/50 horsepower 12 volt DC motor operating at 1750 rpm is used with a pulley 43 (see the lower left hand portion of FIG. 3) and plastic belting 28.

While in the foregoing specification a detailed description of an embodiment of the invention has been set down for the purpose of illustration, many variations in the details hereingiven may be made by those skilled in the art without departing from the spirit and scope of the invention.

I claim:

1. A method of fold-conditioning a continuous business form web having longitudinally-extending control punch margins and equally longitudinally spaced apart lines of transverse perforation comprising advancing said web along a longitudinally extending path from a printer to a folder, printing said web adjacent one end of said path at a normal speed of web advance and transversely folding said web into a zig-zag stack adjacent the other end of said path also at said normal speed, between said printer and said folder moving said web in a serpentine path defined by a plurality of offset rollers alternately contacting opposite sides of said web to develop an incipient fold by prefolding along each line of perforation, and while positively rotating at least some of said rollers at a surface speed at least greater than said normal speed.

2. The method of claim 1 in which said web is accumulated in random loops between said printer and said offset rollers when said printer and folder are not operating at said normal speed.

3. The method of claim 1 in which said web is cut into stack lengths and folded by oscillating the same so as to always position the initial form length of each stack having corresponding sides facing the same direction.

4. Apparatus for fold conditioning a continuous business form web having longitudinally extending control punch margins and equally longitudinally-spaced apart lines of transverse perforation comprising frame means defining a longitudinally extending path, a printer adjacent one end of said path for advancing said web at a normal speed, a folder adjacent the other end of said path also operating at said normal speed, draw rolls operatively associated with said folder for advancing said web at said normal speed, fold conditioning apparatus in said path between said printer and said draw rolls and including a plurality of offset rollers arranged in zig-zag fashion to provide a serpentine path for said web to alternately contact opposite sides of said web to develop an incipient fold by prefolding along each line of perforation, and means for rotating some of said rollers at a surface speed at least greater than said normal speed.

5. Apparatus according to claim 4 in which an accumulator is interposed between said printer and said fold conditioning apparatus for accumulating said web into random loops when said printer and folder are not operating at said normal speed.

6. The apparatus of claim 4 in which said job separator means is operably associated with said folder.

7. Apparatus for fold conditioning a continuous business form web having longitudinally extending control punch margins and equally longitudinally-spaced apart lines of transverse perforation comprising frame means defining a longitudinally extending path, a printer adjacent one end of said path for advancing said web at a predetermined normal speed, a folder adjacent the other end of said path also operating at said predetermined normal speed, draw rolls operatively associated with said folder for advancing said web at said predetermined normal speed, fold conditioning apparatus in said path between said printer and said raw rolls and including a plurality of offset rollers arranged in zig-zag fashion to provide a serpentine path for said web to alternately contact opposite sides of said web to develop an incipient fold along each line of perforation, and means for rotating some of said rollers at a surface speed at least greater than said predetermined normal speed, said plurality of offset rollers including two sub-pluralities of rollers with the rollers in each sub-plurality being spaced apart in the direction of said path, the sub-pluralities being spaced apart and generally parallel to each, the rollers in one sub-plurality being offset in the direction of said path from the rollers in the other sub-plurality to provide said serpentine path, said rotating means being coupled to one of said sub-pluralities of rollers.

8. The apparatus of claim 7 in which one of said sub-pluralities includes a non-rotating roller operative to guide said web into said serpentine path.

9. Apparatus for fold conditioning a continuous business form web having longitudinally extending control punch margins and equally longitudinally-spaced apart lines of transverse perforation comprising frame means defining a longitudinally extending path, a printer adjacent one end of said path for advancing said web at a predetermined normal speed, a folder adjacent the other end of said path also operatively associated with said folder for advancing said web at said predetermined normal speed, fold conditioning apparatus in said path between said printer and said draw rolls and including a plurality of offset rollers arranged in zig-zag fashion to provide a serpentine path for said web to alternately contact opposite sides of said web to develop an incipient fold along each line of perforation, and means for rotating some of said rollers at a surface speed at least greater than said predetermined normal speed, each roller having a diameter of not more than about ⅜".

* * * * *